US011535499B2

(12) United States Patent
Hausladen et al.

(10) Patent No.: US 11,535,499 B2
(45) Date of Patent: Dec. 27, 2022

(54) FREE FALL WINCH

(71) Applicant: Liebherr-Components Biberach GmbH, Biberach an der Riss (DE)

(72) Inventors: Norbert Hausladen, Biberach (DE); David Führle, Mietingen (DE)

(73) Assignee: Liebherr-Components Biberach GmbH, Biberach an der Riss (DE)

( * ) Notice: Subject to any disclaimer, the term of this patent is extended or adjusted under 35 U.S.C. 154(b) by 284 days.

(21) Appl. No.: 16/812,127

(22) Filed: Mar. 6, 2020

(65) Prior Publication Data

US 2020/0207596 A1 Jul. 2, 2020

Related U.S. Application Data

(63) Continuation of application No. PCT/EP2018/073042, filed on Aug. 27, 2018.

(30) Foreign Application Priority Data

Sep. 6, 2017 (DE) ..... 10 2017 120 490.3

(51) Int. Cl.

| | |
|---|---|
| ***B66D 5/22*** | (2006.01) |
| ***B66D 1/16*** | (2006.01) |
| ***B66D 1/48*** | (2006.01) |
| ***B66D 5/24*** | (2006.01) |
| *B66D 1/22* | (2006.01) |

(52) U.S. Cl.

CPC ..... *B66D 5/22* (2013.01); *B66D 1/16* (2013.01); *B66D 1/48* (2013.01); *B66D 5/24* (2013.01); *B66D 1/22* (2013.01); *B66D 2700/0125* (2013.01)

(58) Field of Classification Search

CPC ..... B66D 1/16; B66D 1/22; B66D 1/48–54; B66D 5/22; B66D 5/24; B66D 2700/0125

See application file for complete search history.

(56) References Cited

U.S. PATENT DOCUMENTS

| | | | | |
|---|---|---|---|---|
| 6,179,271 | B1 * | 1/2001 | Yamagata | B66D 5/14 254/365 |
| 2008/0224112 | A1 * | 9/2008 | Epplin | B66D 1/48 254/323 |
| 2014/0083806 | A1 * | 3/2014 | Miyazaki | B66D 5/28 188/151 R |
| 2017/0210606 | A1 * | 7/2017 | Kawai | B66D 5/18 |

FOREIGN PATENT DOCUMENTS

| | | |
|---|---|---|
| DE | 972151 | 5/1959 |
| DE | 2017948 | 10/1971 |
| DE | 3223632 | 10/1988 |

(Continued)

*Primary Examiner* — Sang K Kim
*Assistant Examiner* — Nathaniel L Adams
(74) *Attorney, Agent, or Firm* — Levine Bagade Han LLP

(57) ABSTRACT

The invention relates to a free fall winch comprising a drum, which can be rotationally driven by a winch drive, wherein a free fall brake is provided for braking the drum in free fall operation. According to the invention, a torque acting on the free fall winch, which depends on the free fall braking torque, is detected by means of a detection device, and a brake actuation force with which the free fall brake is actuated is controlled or adjusted by a control device according to the detected torque.

21 Claims, 7 Drawing Sheets

(56) References Cited

FOREIGN PATENT DOCUMENTS

| | | | |
|---|---|---|---|
| DE | 3927354 | | 4/1991 |
| DE | 9315641 | | 2/1994 |
| DE | 20000913 | | 4/2001 |
| DE | 10116342 | | 2/2003 |
| DE | 102007055136 | | 1/2009 |
| DE | 102014109918 | | 1/2016 |
| DE | 102015003980 | | 9/2016 |
| DE | 102017116956 | A1 * | 1/2019 |
| EP | 0538662 | | 5/1997 |
| EP | 1870985 | | 12/2007 |
| WO | WO 2019/048282 | | 3/2019 |

* cited by examiner

FREE FALL WINCH

CROSS-REFERENCE TO RELATED APPLICATIONS

This application is a continuation of International Patent Application Number PCT/EP2018/073042 filed Aug. 27, 2018, which claims priority to German Patent Application Number 10 2017 120 490.3 filed Sep. 6, 2017, both of which are incorporated herein by reference in their entireties.

BACKGROUND

The present invention relates to a free fall winch having a drum that is rotationally drivable by a winch drive, wherein a free fall brake is provided for braking the drum in free fall operation.

Free fall winches are used in different applications in which the rope wound on the drum of the winch or another pulling or hoisting means such as a belt is to be unreeled or lowered at high speeds over longer distances, wherein the drum rotates more or less free of resistance in no-load operation or optionally also with a slight braking due to the gear resistances. Such an unreeling is sometimes called "free fall". It is here at least necessary at the end of the free fall to brake the hoisting drum relatively rapidly to avoid an uncontrolled further unreeling of the rope and as a consequence thereof slack rope on the winch drum and a slipshod, untidy rope appearance.

Such free fall winches can be used, for example, in cable excavators when for example, a compacting mass is dropped to the ground in free fall for soil compaction. For this purpose, for example, with planetary gears used on drums, individual planetary stages are decoupled so that the compacting load reaches the ground with a falling energy that is as high as possible. Briefly before impacting the ground, however, the free fall brake has to be applied so that no slack rope can be produced on the winch drum. This procedure is cyclically repeated at brief intervals, whereby the cooling oil of the free fall brake and the coefficients of friction of the brake blocks change. The excavator operator accordingly has to continuously readjust the braking of the free fall winch.

When working with a dragline bucket, the latter is cast into a quarry pond—in a similar manner to the casting of a fishhook by a fishing rod—by a rotation of the cable excavator superstructure to e.g. to quarry gravel. When the dragline bucket impacts the water surface, the previously released drum has to be braked to avoid slack rope.

With slurry wall grabs, by means of which very deep foundations are excavated, the lowering of the grab takes place at a high, controlled rate of fall, with said rate of fall already having to be controlled by braking the free fall brake during the lowering to control the rate of fall. Due to a heating of the system and a change in the coefficients of friction of the brake blocks, it also becomes necessary here that the braking force of the free fall brake has to be readjusted to lower the rope having the grab linked thereto at a desired speed and in so doing to maintain a certain rope tension.

It is also desirable during different handling work to be able to easily pull off the rope from the free fall winch by hand, for example to fasten the rope to different pieces of equipment. In this respect, frictional forces in the interior of the winch, for example in the region of a gear via which the winch drive drives the drum and in the region of the free fall brake itself also have to be overcome with an open free fall brake. This is in particular practically not possible by hand with cold lubricant having a correspondingly high viscosity so that assistance by the winch drive would be desirable, with this drive assistance of the manual removal in the desired amount depending, however, on the temperature of the lubricant. Whereas greater assistance is required with cold lubricant, a powered removal assistance at the same level with heated lubricant having a still only low viscosity can result in an undesirably fast unreeling.

A free fall winch of the initially named kind is shown, for example, by document EP 0 538 662 B1 in which the winch drive drives the drum via a two-stage planetary transmission that is accommodated in the interior of the drum. A sun gear of one of the planetary stages can here be driven by the winch drive and can, on the other hand, be blocked by a holding brake. A planetary carrier of one of the planetary stages is led out via a shaft from the opposite end of the drum to be able to be braked there by a free fall brake that is supported at the counter-bearing plate.

Free fall winches are furthermore also known that work with only one brake and that use the holding brake simultaneously as a free fall brake. DE 3 223 632 C2, for example, shows a free fall brake whose drum is driven by a hydraulic motor via a two-stage planetary transmission, with the ring gear common to both planetary stages being connected to a braking plate to which the drum brake directly acting on the flanged pulley of the hoisting drum is fastened. With a closed brake, the torque is transmitted to the hoisting drum via the brake and the connection between the motor and the hoisting drum is thus achieved, while the planetary transmission is decoupled from the hoisting drum with an open brake. The described cooling problem, however, remains with this brake arrangement. In addition, high braking forces that have to be transmitted to the drum jacket via the flanged pulley at which the brake engages have to be applied to retain the hoisting drum in load operation, for example when retaining a large raised load.

A Kelly winch is known from document DE 101 16 342 C2 with which the rope pull or a torque associated therewith is monitored at the drum on the unreeling of the rope. For this purpose, the winch drive is generally rotatably supported at the drum, but is supported at the rack via a lever-shaped torque support, with a measurement device detecting the load on the torque support to determine the supported torque. The winch drive is controlled in dependence on the detected load on the torque support such that a certain load on the torque support is not fallen below and thus an accompanying torque is maintained at the drum and a residual tension force is thus correspondingly maintained at the rope to prevent slack rope.

Document DE 10 2014 109 918 A1 furthermore shows a drilling apparatus whose drilling tool can be lowered along a mast by a winch. A hydraulic pump driving the winch is here controlled in dependence on a rope tension force that is measured by means of a force measuring pin at a deflection pulley of the rope.

Starting from this, it is the underlying object of the present invention to provide an improved free fall winch of the initially named kind that avoids disadvantages of the prior art and further develops the latter in an advantageous manner. A stable free fall operation should in particular be made possible independently of fluctuations in the lubricant temperature and lubricant viscosity and changing coefficients of friction of the free fall brake pads. An overload protection of the winch in free fall operation and a simple manual removal operation should furthermore advantageously be made possible.

BRIEF SUMMARY

In accordance with the invention, said object is achieved by a free fall winch in accordance with claim 1 and by a method in accordance with claim 20. Preferred embodiments of the invention are the subject of the dependent claims.

It is therefore proposed to detect torques acting on the free fall winch in free fall operation and to adapt the actuating power of the free fall brake in dependence hereon. Magnitudes of disruption or influence that have an unwanted effect on free fall operation can be compensated and stable free fall operation can be achieved by the taking into account of the actually acting current torque at the free fall winch. In accordance with the invention, a torque that acts at the free fall winch and that depends on the free fall braking torque is detected by means of a detection device and a braking control force by which the free fall brake is actuated is controlled or adapted by a control device in dependence on the detected torque. The actuation force can in particular hereby be readjusted with a changing lubricant temperature and lubricant viscosity or with falling coefficients of friction of the free fall brake to maintain a desired level of free fall braking torque.

A controlled system is set up in this process in an advantageous further development of the invention, for which purpose said control device can comprise a controller module that regulates the braking control force of the free fall brake in dependence on the detected torque and a predefinable desired value and/or reference value. Said controller module can here take account of a desired braking torque, for example, and can adjust the braking control force such that a difference between the detected torque and the wanted desired torque becomes or remains as small as possible. Said desired braking torque can here, for example, be predefined by the position of a brake pedal or of a brake lever, with the actuation force of the free fall brake no longer being positively controlled by the pedal force or lever force in the sense of a forced coupling between the brake actuator and the brake pedal. The control distance and/or the control force by which the brake pedal or the brake lever is actuated is detected and predefines the wanted desired braking torque, with said controller module adjusting the actuation force of the brake such that the actually achieved actual braking torque comes as close as possible to the wanted desired torque.

Alternatively or additionally, said controller module can, as the reference value, also take account of a drum rotational speed and/or a rope uncoiling speed and can adjust the braking control force of the free fall brake such that a desired drum rotational speed and/or rope uncoiling speed is maintained with as small a difference as possible. For this purpose, the actual drum rotational speed and/or the actual rope uncoiling speed can be detected by means of a rotational speed detector or a speed detector.

To ensure a detection of the torque induced by the free fall brake that is as exact as possible, the torque can be detected directly at the drive train by which the drum is driven and/or directly at the free fall brake and/or directly at an additionally present holding brake, with the torque detection device advantageously being able to be associated directly with said drive train and/or directly with the free fall brake and/or directly with the holding brake.

The torque detection device can in particular have a torque sensor integrated in the winch drive and associated with its drive shaft for detecting the drive shaft torque of the winch drive. The torque sensor can, for example, be arranged in the interior of the motor housing or can be rotationally fixedly connected to a stub shaft exiting the motor housing, with the torque sensor being able to have, for example, a torsion measurement device for measuring the torsion produced at the drive shaft. Alternatively or additionally, such a torque sensor can also be associated with a transmission input shaft that is driven by the winch drive and is part of a transmission via which the drive movement of the winch drive is transmitted to the drum.

Such an arrangement of the torque sensor integrated into the winch drive motor and/or into the transmission can in particular be of advantage when the free fall brake is associated with the drive train and/or forms part of the drive train and/or is arranged such that the free fall torque is torque-transmitting and/or force-transmitting to transmit the drive force or the drive torque of the winch drive to the drum. The free fall brake can, for example, retain a transmission element in normal winch operation and/or can fix it relative to the drum so that the drive torque of the winch drive is transmitted to the drum, whereas, with an open free fall brake, said transmission element is released and the drive train between the winch drive and the drum is interrupted.

On a configuration of said transmission as a planetary transmission, for example, the free fall brake can retain or release a sun gear or a ring gear of a planetary stage in said manner to transmit or not transmit the drive movement of the winch drive to the drum.

Said arrangement of the torque sensor at the motor shaft and/or at the transmission input shaft is here subject to the consideration that the sum of all the torques at the transmission that transmits the drive movement of the winch drive to the drum has to be 0, from which it follows that the torque measured by the torque sensor at the motor drive shaft and/or at the transmission input shaft corresponds to the free fall braking torque when the free fall brake provides a corresponding braking torque in free fall operation.

Alternatively or additionally, a torque sensor can be arranged at a holding brake to determine the reaction torque of the holding brake that is induced at the holding brake in free fall operation. For this purpose, said holding brake can be supported rotatably per se and can be supported by a support element so that the induced reaction torque can be determined by a force measurement device associated with this support element or by a torque sensor associated with the support element.

In this respect, the winch drive can advantageously be connected to said holding brake and can in particular be fastened to the part of the holding brake supported by said support element so that the reaction force or the reaction torque at the support of the holding brake provides the desired torque signal both with a closed holding brake and with an open holding brake. If the holding brake is open, the torque sensor reflects the reaction torque that is inducted via the motor and that is introduced into the supported part of the holding brake.

Alternatively or additionally to a torque sensor at the holding brake and/or at the winch drive and/or at the transmission, a torque sensor can also be directly associated with the free fall brake to directly detect the braking torque provided by the free fall brake. The free fall brake can be rotatably supported per se for this purpose and can be supported against rotation by a support. The torque sensor, for example in the form of a force measurement device, is associated with said support to determine the free fall braking torque from the reaction force or reaction torque at the support.

Alternatively or additionally, the torque to be detected can also be detected at one of the two bearing plates of the free fall winch and can be used to control or regulate the free fall brake.

Even if unwanted influences such as a temperature change and viscosity change of the coolant of the winch can be compensated by the detection of the torques induced by the free fall brake at the winch and by taking this into account in the control of the control force of the free fall brake, it can be advantageous in a further development of the invention to avoid an excessive heating or excessive temperature fluctuations at the free fall winch and at the braking elements of the free fall brake in advance. Provision can advantageously be made for this purpose to arrange the free fall brake such that the free fall brake can also rotate in winch operation and/or that the counter-bearing plate can also be rotated with a fixed free fall brake. For this purpose, the free fall brake is no longer, as previously customary, rotationally fixedly supported at the counter-bearing plate, but is rather arranged in the interior of the drum between the drum and the winch drive and the holding brake. The free fall brake can in particular be arranged between the winch drive and the holding brake, on the one hand, and the drum, on the other hand, such that with an open free fall brake, the drum is decoupled from the winch drive and from the holding brake and can free wheel with respect to the winch drive and the holding brake.

The free fall brake is in particular arranged such that at least one part of the free fall brake always rotates with the drum and/or with the winch drive. Unlike free fall brakes arranged in a standing position at the counter-bearing plate, a cooling that is a great deal better can be achieved by the continuous running along of the free fall brake since the cooling fluid washing around the free fall brake is constantly circulated or since at least a forced convection is achieved if no liquid washes around the free fall brake. At the same time, due to the rotational decoupling of the free fall brake from the counter-bearing plate, it is avoided that the braking torque of the free fall brake has to be removed via the counter-bearing plate. The counter-bearing plate can accordingly only be designed for its support function and can be designed as less solid. At the same time, the counter-bearing plate can also be rotated with a closed free fall brake, which substantially simplifies the assembly of the winch.

In a further development of the invention, one half of the free fall brake can be rotationally fixedly connected to the hoisting drum and the other half of the free fall brake to a transmission element of the transmission so that at least one part of the free fall brake is formed as rotating along with the drum both with an open and a closed free fall brake. The rotationally fixed connection of the one free fall brake half to the hoisting drum can here take place by a direct fastening to the hoisting drum or by an indirect fastening via an intermediate part rotationally fixedly connected to the hoisting drum.

Said free fall brake is in particular received in the interior of the drum jacket of the drum and is fastened to an outer free fall brake part at the drum jacket or to a jacket attachment part rigidly connected thereto so that said outer free fall brake part always rotates along with the drum jacket. Due to the arrangement in the interior of the drum jacket, the free fall brake can run in an oil bath or cooling fluid bath that is provided there and that can advantageously also be used to lubricate and/or cool the transmission when the transmission is advantageously simultaneously received in the interior of the drum jacket. A particularly efficient cooling of the free fall brake can hereby be achieved.

Said transmission, via which the winch drive drives the drum, can here advantageously comprise a single-stage or multi-stage planetary transmission that can be received in the interior of the drum. An inner free fall brake part can advantageously be rotationally fixedly connected to a planetary transmission element to rotate along with said planetary transmission element. They can be different planetary transmission elements depending on the configuration.

The free fall brake can advantageously be actuated, i.e. released and/or fixed, via an actuation unit that can be arranged on a side of the drum disposed opposite the winch drive and/or the holding brake.

Said actuation unit is here advantageously rotatably supported at a counter-bearing plate and/or is configured as rotatable per se so that at least one part of said actuation unit is also freely rotatable with respect to the counter-bearing plate with an applied free fall brake. No torque is hereby transmitted to or supported on said counter-bearing plate.

To avoid the introduction of the axial control forces of the actuation unit onto the counter-bearing plate the actuation unit can also be axially supported at the drum itself.

Said actuation unit advantageously extends at least partially, preferably predominantly, within the drum.

Said free fall brake can advantageously be configured as a multi-disk brake, with a first set of disks being able to be rotationally connected to the drum and a second set of disks being able to be rotationally fixedly connected to a transmission element. The mutually engaging sets of disks can advantageously be arranged transversely, in particular perpendicular, to the axis of rotation of the drum and/or can be received in the interior of the drum jacket.

BRIEF DESCRIPTION OF THE DRAWINGS

The invention will be explained in more detail in the following with reference to an advantageous embodiment. There are shown in the drawing.

DETAILED DESCRIPTION

Figure 1:
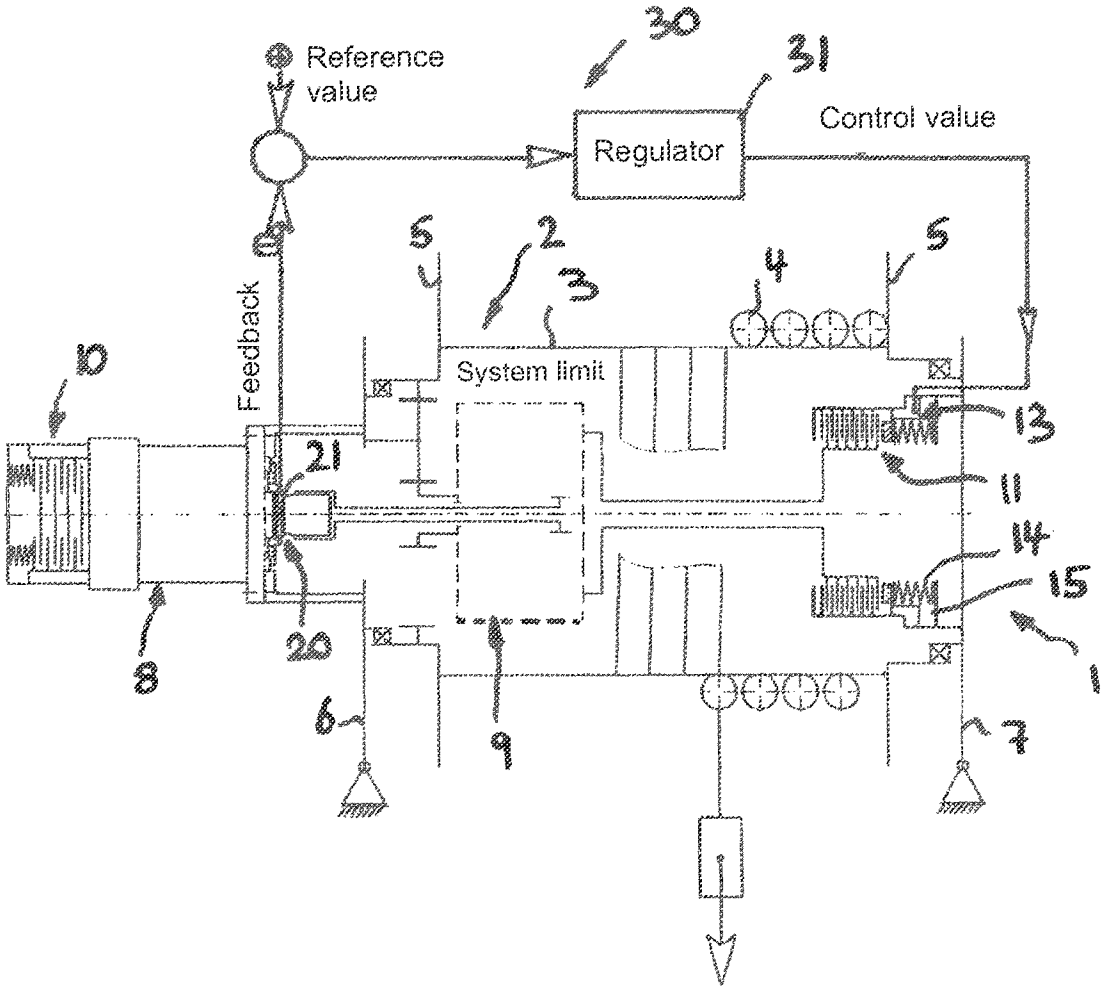
FIG. 1: a schematic sectional view of a free fall winch in accordance with an advantageous embodiment of the invention in which a torque sensor is integrated in the winch drive and the control force of the free fall brake is regulated in dependence on the detected torque.

As FIG. 1 shows, the free fall winch 1 comprises a drum 2 that has an approximately cylindrical drum jacket 3 onto which a rope 4 can be wound. Said drum jacket 3 can have rope grooves at its outer side for this purpose to wind the rope 4 on the drum 2 in a controlled manner. Said drum jacket 3 is encompassed laterally or at its ends by respective guard plates 5 that extend transversely to the longitudinal axis of the drum jacket 3 and project beyond its outer dimension.

The drum 2 is rotatably supported in parallel with the longitudinal axis of the cylindrical drum jacket 3. A pair of bearing plates 6 and 7 at which the drum 2 is rotatably supported can be provided for this purpose. The bearing plates 6 and 7 themselves are mounted at a base structure on which the hoisting winch is to be used, for example the superstructure of a cable excavator.

The hoisting winch further comprises a winch drive 8, for example in the form of an electric motor or of a hydraulic motor, that can be arranged and supported in a fixed position at a side of the drum 2, for example outside the bearing plate 6 provided there, for example supported at said bearing plate.

The winch drive 8 can here rotationally drive the drum 2 via a transmission 9, with said transmission 9 advantageously being able to comprise a planetary transmission that can be configured as single-stage or multi-stage.

As FIG. 1 shows, said transmission 9 can be received in the interior of the drum jacket 3 so that the winch drive 8 and the predominant portion of the transmission 9 extend on oppositely disposed sides of the bearing plate 6.

The winch drive 8 can, for example, be a sun gear of a planetary stage that is arranged in the interior of the drum jacket 3 and whose planetary carrier can be coupled to the sun gear of a further planetary stage. The planetary transmission can here have 2 or 3 or even more planetary stages to achieve the desired transmission ratio.

To be able to retain or fix the hoisting winch under load, a holding brake 10 is provided that can engage at the winch drive 8. The holding brake 10 can advantageously be arranged on the side of the winch drive 8 remote from said transmission 9, in particular coaxially to the output shaft of the winch drive 8. The holding brake 10 can, for example, act on the motor shaft that can be connected to the sun gear of the previously named planetary stage on the one side and to the holding brake 10 on the oppositely disposed side.

Said holding brake 10 can, for example, be a multi-disk brake that can be fixed by a preload device, for example in the form of a spring device, and can be released by pressure means.

As FIG. 1 shows, the free fall winch further comprises a free fall brake 11 that can, for example, be arranged on the side of the drum 2 within the drum 2 disposed opposite the winch drive 8. The free fall brake 11 can here advantageously be coupled to a transmission element of the transmission 9 to retain or release said transmission element so that the drum 2 is coupled to the winch drive 8 via the transmission 9 or is rotatable in a free-wheeling manner with respect thereto.

There are generally different options for this. The free fall brake 11 can, for example, block or retain a transmission element. A sun gear of the planetary transmission or a ring gear of the planetary transmission can, for example, be retained or blocked at the counter-bearing plate 7 so that the transmission element can no longer be rotated and the drive movement is transmitted to the drum. In this case, the counter-bearing plate 7 takes up the corresponding torque. If said sun gear or ring gear is released, the planetary transmission can so-to-say spin and the drum can be rotated with respect to the motor while free-wheeling in that only the rotational resistance of the transmission has to be overcome.

Figure 7:
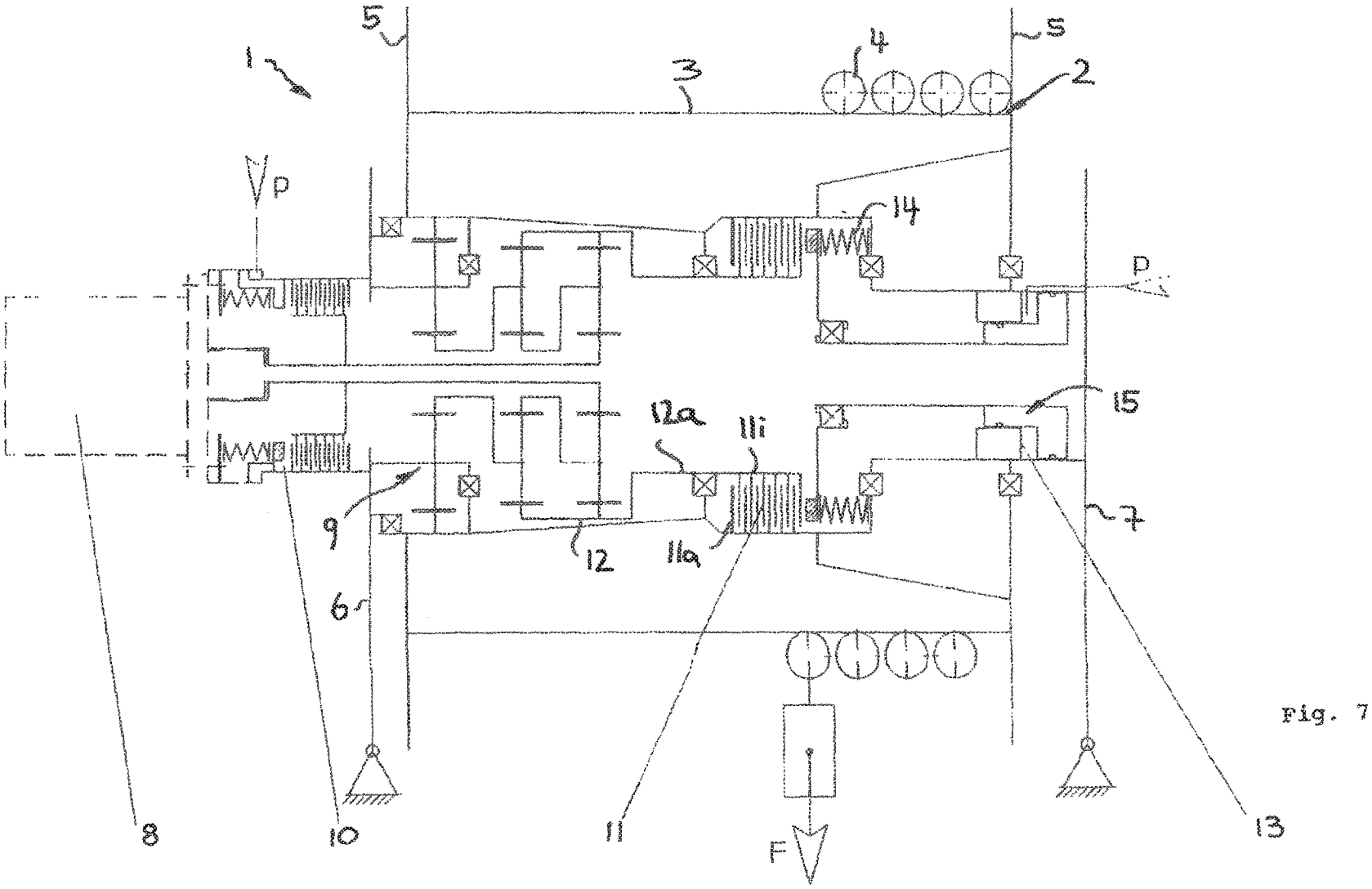
FIG. 7: a schematic sectional view of a free fall winch in accordance with an advantageous embodiment of the invention with a free fall brake not at a fixed position.

Alternatively to this, said transmission element, for example said sun gear or said ring gear, can be retained at the drum 2 itself so that it rotates with the drum 2 when the free fall brake 11 is closed. FIG. 7, for example, shows such an embodiment—that is in another respect very similar to the embodiment in accordance with FIG. 1. The free fall brake 11 there couples said transmission 9 to the drum 2 such that the free fall brake 11 is arranged in the flow of force between the winch drive 8 and the drum 2.

Said free fall brake 11 in accordance with FIG. 7 can in particular connect a transmission element of the transmission 9 to the drum 2 so that with a closed free fall brake 11, said transmission element can drive the drum 2 and with an open free fall brake 11, the drum 2 can be rotated decoupled from the transmission 9 in a free-wheeling manner.

The free fall brake 11 can advantageously couple a ring gear 12 of the planetary transmission to the drum jacket 3 so that—with an open free fall brake 11—one portion of the free fall brake 11 rotates along with the drum jacket 3 and the other portion of the free fall brake 11 rotates along with the ring gear 12 so that said ring gear 12 rotates. As FIG. 1 shows, said ring gear 12 can have a cylindrical prolongation 12*a* that can act as a brake carrier and can be rotationally supported at the drum jacket 3. An inner free fall brake part 11*i* can be rotationally fixedly fastened to said ring gear cylinder 12*a* while an outer free fall brake part 11*a* can be rotationally fixedly fastened to the inner jacket side of the drum jacket 3 or to an intermediate part rigidly connected thereto.

As FIG. 7 shows, the free fall brake 11 can advantageously be configured as a multi-disk brake whose two mutually engaging disk sets are arranged transversely to the axis of rotation of the drum 2. A first disk set can be rotationally fixedly fastened to the inner side of the drum jacket 3 while a second disk set is rotationally fixedly coupled to the ring gear 12 or to another transmission element.

The free fall brake 11 can be completely received in the interior of the drum jacket 3.

The free fall brake 11 can be actuated, i.e. released and/or fixed, by an actuation device 13 that can advantageously likewise extend at least predominantly in the interior of the drum jacket 3. Said actuation device 13 can comprise a preload device 14 that fixes the free fall brake 11 under a preload. Said preload device 14 can, for example, be a spring device that can axially preload the disks of the free fall brake 11, cf. FIG. 1.

A pressure means device for releasing the preload can comprise a piston-in-cylinder unit 15 that is coupled to the inner free fall brake part 11*i*, on the one hand, and to the outer free fall brake part 11*a*, on the other hand, to tension the two brake parts against one another or to release them from one another, with the activation direction of the piston-in-cylinder unit 15 being, for example, axial, that is, substantially in parallel, with respect to the axis of rotation of the drum 2.

Said piston-in-cylinder unit 15 can likewise be at least partly received in the interior of the drum 2. Irrespective of this, the piston-in-cylinder unit 15 can be rotatably supported with respect to the drum 2 and/or can be axially supported thereat so that brake forces are supported directly at the drum 2, cf. FIG. 7. The counter-bearing plate 7 in particular remains freely rotatable irrespective of whether the free fall brake 11 is fixed or released. The counter-bearing plate 7 does not need to take up any reaction torques even if the free fall brake is braked.

In normal hoisting operation, said free fall brake 11 remains closed so that the winch drive 8 can drive the transmission 9 configured as a planetary transmission, with the rotational movement of the transmission 9 being given onto the drum 2.

In the embodiment in accordance with FIG. 7, the free fall brake 11 rotates along at the rotational speed of the drum 2 in normal hoisting or winch operation so that the disks of the free fall brake 11 circulate in the oil bath that can be provided in the interior of the drum 2 to lubricate the transmission 9. To amplify the circulation effect, the inner and outer parts of the free fall brake 11 can be provided with a grooving through which the oil or the cooling fluid can flush through the free fall brake better. The free fall brake 11 can, however, also be supported in a standing manner at the counter-bearing plate, as will still be explained.

The free fall brake 11 is released in free fall operation. At the same time, the winch drive 8 and/or the holding brake 10 are braked so that the input shaft of the transmission 9 is stationary. The drum 2 can nevertheless rotate since said sun gear or ring gear is decoupled from the drum jacket 3 by the released free fall brake 11.

Since ultimately the sum of all the torques at the transmission 9 has to be zero, a torque is produced at the input side of the transmission 9, that is connected to the winch drive 8, that corresponds to the braking torque of the free fall brake 11 so that a torque induced by the free fall brake torque can also be measured at the motor side.

As FIG. 1 shows, a detection device can in particular be integrated in the winch drive 8 for detecting the torque, with the detection device 20, for example, being able to have a torque sensor 21 that can be seated on the motor shaft or can at least sectionally surround the motor shaft at the peripheral side. Alternatively or additionally, a measurement element can also be arranged in the interior of the drive shaft if the drive shaft is formed as hollow or has a corresponding hollow space. The torque sensor 21 can, for example, also be disposed at the intersection between the motor shaft and the transmission input shaft.

The actual torque detected by the torque sensor 21 is supplied to a control device 30 by means of which the actuation of the free fall brake 11 is controlled or adapted. Said control device 30 can in particular comprise a regulator 31 that regulates the brake control force applied by the actuation device 13 in dependence on the detected actual torque such that the braking torque effected by the free fall brake 11 comes as close as possible to the wanted desired torque.

The wanted desired braking torque can be predefined by a brake pedal or by a brake lever whose actuating path and/or actuation force can be queried by a sensor.

As FIG. 1 shows, a further reference value can also be supplied to the regulator 23, for example in the form of a desired rotational speed of the hoisting winch at which the drum 2 unreels the rope in free fall operation. The regulator 31 can control the actuation device 13 such that the rotational speed achieved comes as close as possible to the desired rotational speed.

The influence of the oil viscosity and of the change of the coefficients of friction of the free fall brake 11 can be reduced or in the best case fully eliminated by said regulation or control. Said manual action of the machine operator can optionally also be eliminated, in particular such that the brake pedal no longer has to be more or less powerfully actuated. A control signal "free fall" can, for example, be input, for example via a touchscreen, whereupon the free fall winch is operated in free fall and the regulator 31 regulates the desired braking force to achieve a desired withdrawal speed or drum rotational speed. In this respect, the withdrawal length can also be monitored to, for example, again brake the winch toward the end of the desired free fall.

Figure 2:
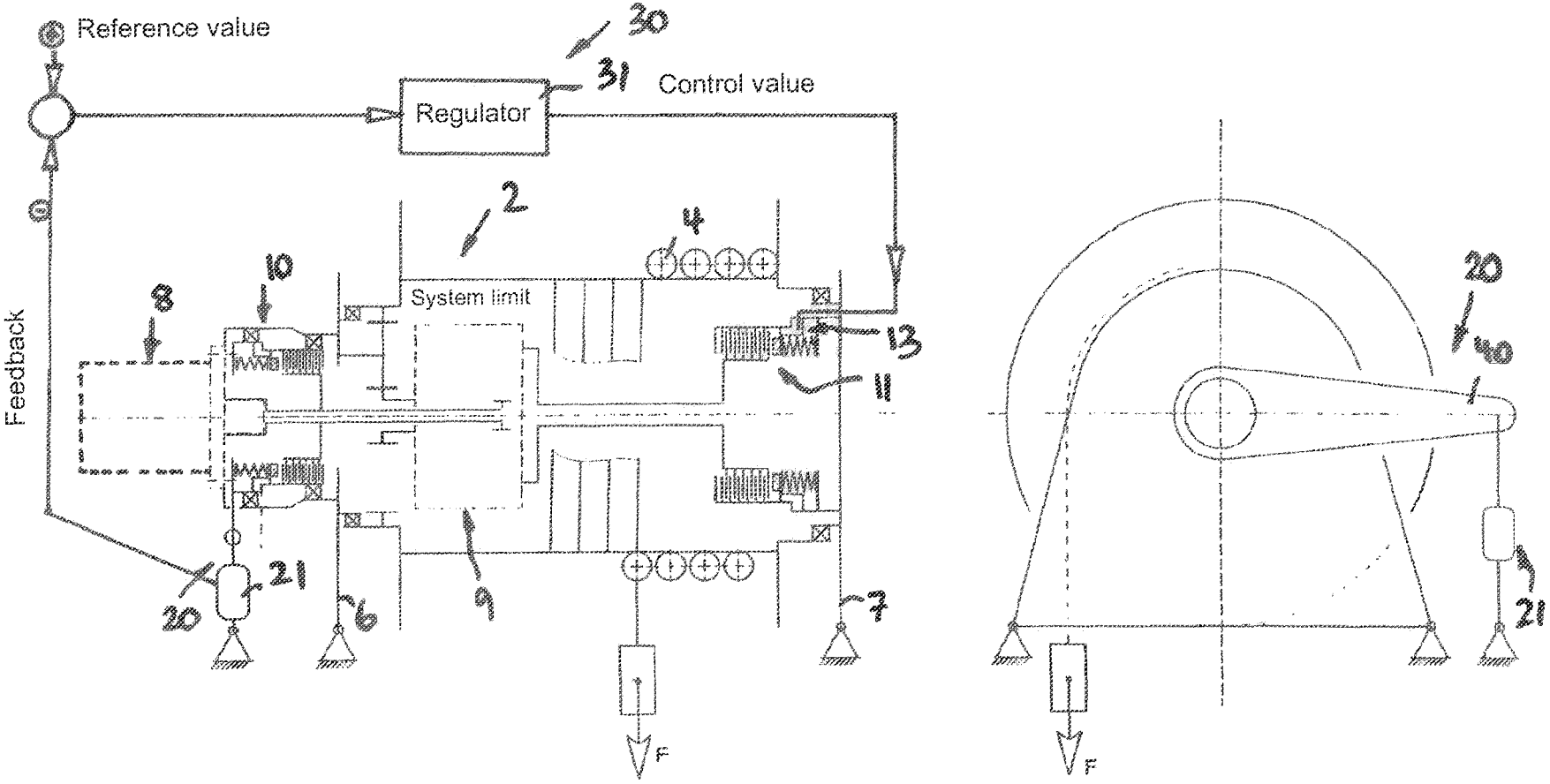
FIG. 2: a schematic sectional view of a free fall winch in accordance with a further advantageous embodiment of the invention in which a torque sensor is associated with a holding brake and detects the reaction torque at a holding brake, with the part view (a) showing a longitudinal section of the free fall winch and the part view (b) showing a frontal view of the support lever of the holding brake and of the load cell associated therewith.

As FIG. 2 shows, the actual torque used for the regulation can also be detected at the holding brake 10. The holding brake 10 per se can for this purpose be rotationally fixedly supported, but be supported against rotation by a support 40, cf. FIG. 2. A torque sensor 21, for example in the form of a load cell, can be associated with the support 40 that intercepts the rotation of the holding brake 10 in free fall operation to detect the load of the support 40 and thus the induced torque.

The winch drive 8 can here be supported in a fixed position, for example fixedly supported at the bearing plate.

The actual value of the torque detected at the holding brake 10 is supplied to the control device 30, in particular to its regulator 31, in a similar manner to that described for FIG. 1 to regulate the free fall braking operation.

Figure 3:
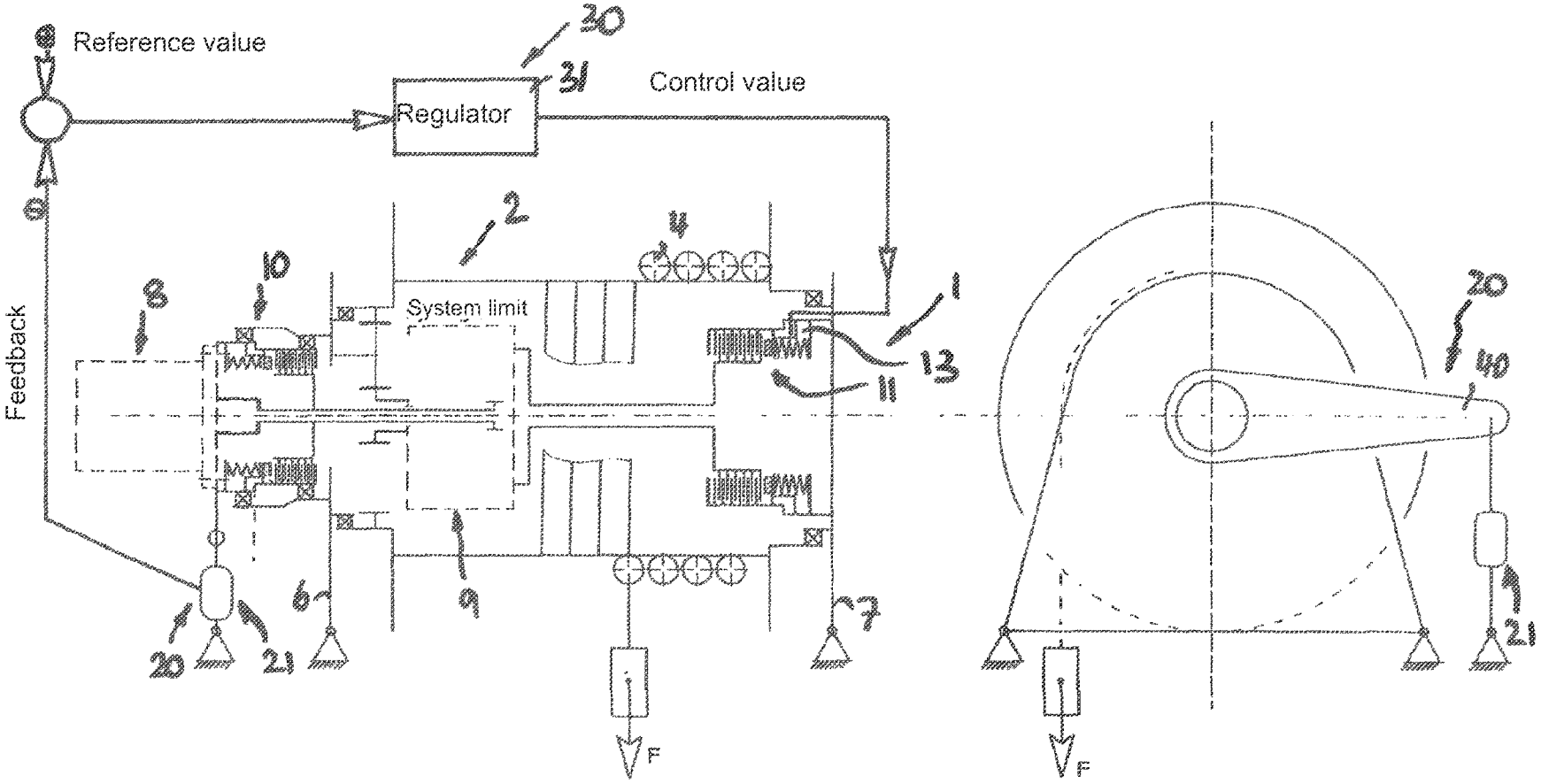
FIG. 3: a schematic sectional view of a free fall winch in accordance with a further advantageous embodiment of the invention in which a torque sensor is associated with a holding brake and detects the reaction torque at a holding brake, with the part view (a) showing a longitudinal section of the free fall winch and the part view (b) showing a frontal view of the support lever of the holding brake and of the load cell associated therewith, with the motor not being independently supported at a fixed position in comparison with FIG. 2, but rather being fastened to the supported part of the holding brake.

FIG. 3 shows a similar embodiment to FIG. 2, with the actual value of the torque also being detected at the holding brake 10 here. The holding brake 10 per se is for this purpose in turn rotatably supported, but supported via a support 40 such that the torque acting on the holding brake can be detected by the detection of the load of the support arm. Unlike the embodiment in accordance with FIG. 2, in the embodiment in accordance with FIG. 3, the winch drive 8 is, however, not supported in a fixed position, but is rather rotationally fixedly fastened to the holding brake 10, more precisely to the stationary part of the holding bake 10 that is supported against rotation in the previously described manner by the support 40.

The advantage of the embodiment in accordance with FIG. 3 above all comprises the fact that the induced torque can be measured both with a closed holding brake 10 and an open holding brake 10. Since the winch drive 8 is supported at the holding brake 10, the torque applied by the motor or by the winch drive 8 is likewise intercepted via the support 40 and is measured by the associated torque sensor 21.

Figure 4:
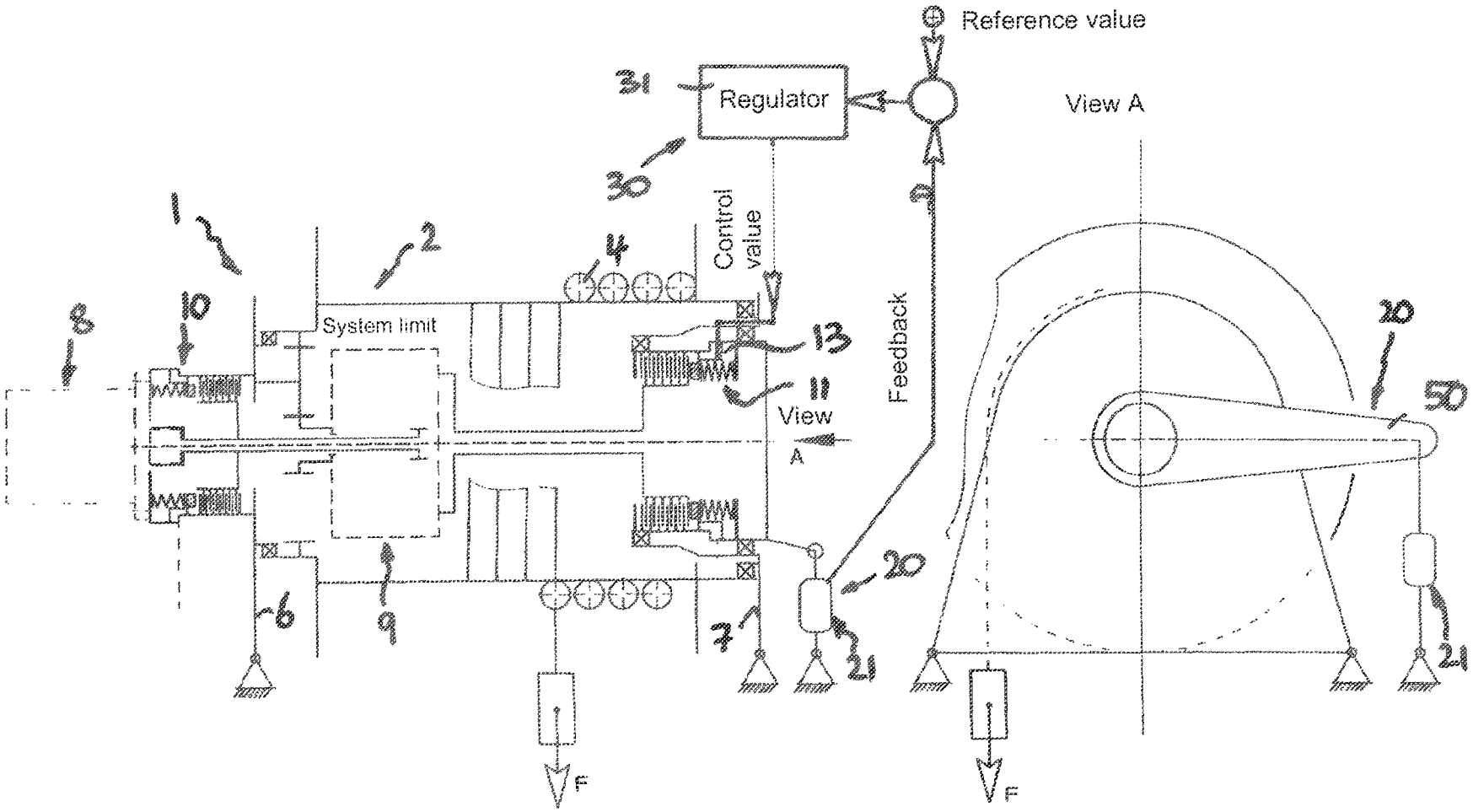
FIG. 4: a schematic sectional view of a free fall winch in accordance with a further advantageous embodiment of the invention, with a torque sensor being directly associated with free fall brake, and with the part view (a) showing a longitudinal section through the free fall winch and the part view (b) showing a plan view of the support lever of the free fall brake, with a load cell being associated with said support lever to detect the reaction torque.

As FIG. 4 shows, the torque to be detected can also be measured directly at the free fall brake 11 itself. The free fall brake 11 can for this purpose be rotatably supported per se, but—in a similar manner as previously the holding brake 10—supported against rotation by a support 40. The forces acting at the support 50 can be detected by means of a load cell so that the arrangement of load cell and support 50 forms the torque sensor 21.

The torque signal acquired at the free fall brake 11 can be supplied to the regulator 31 in an analog manner to that previously described to regulate the actuation of the free fall brake in a desired manner and to control its actuation device 13.

Figure 5:
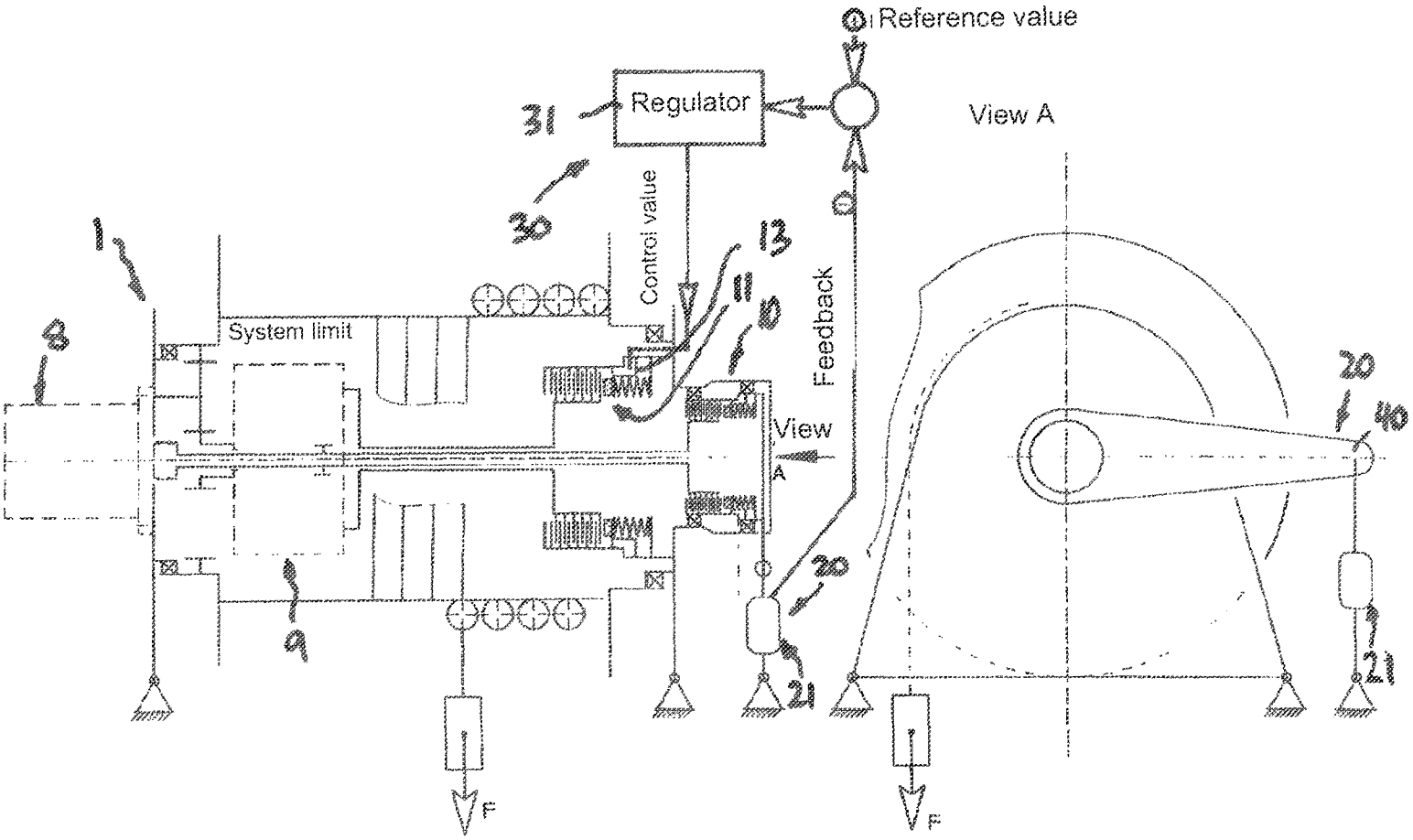
FIG. 5: a schematic sectional view of a free fall winch in accordance with a further advantageous embodiment of the invention in which a torque sensor is associated with a holding brake and detects the reaction torque at a holding brake, with the part view (a) showing a longitudinal section of the free fall winch and the part view (b) showing a frontal view of the support lever of the holding brake and of the load cell associated therewith, with the holding brake being arranged on the winch side disposed opposite the motor and being connected to the transmission input shaft or with the motor output shaft through a hollow shaft.

As FIG. 5 shows, the previously described holding brake 10 can also be arranged at the side of the free fall brake 11. The motor shaft of the winch drive 8 that can be arranged in a fixed position or in a rotationally fixed position, can in particular be fastened to the bearing plate 6 and/or the input shaft of the transmission 9 can, for example, be conducted via a hollow shaft to the oppositely disposed winch side and can there be connected to the holding brake 10, cf. FIG. 5.

The holding brake 10 can here be supported in a similar manner as previously described in the embodiment in accordance with FIG. 2 rotatably per se and supported against rotation via a support 40. The torque sensor 21 that is associated with the support 40 and that can comprise the load cell shown in FIG. 5 (*b*) detects the load at the support 40 and thus the torque induced at the holding brake 10. The corresponding torque signal can be supplied to the regulator 31 in an analog manner as previously described.

Figure 6:
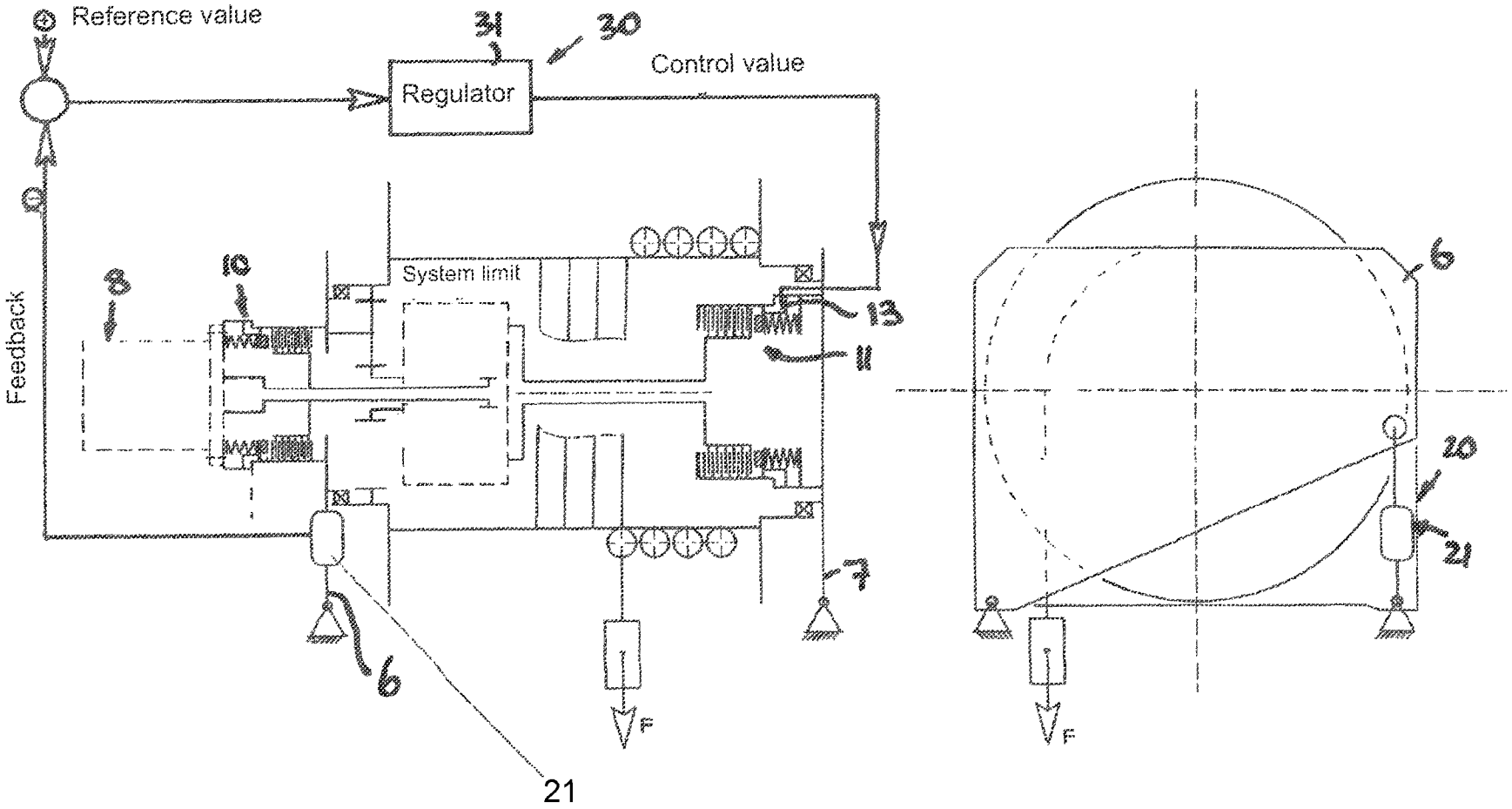
FIG. 6 a schematic sectional view of a free fall winch in accordance with a further advantageous embodiment of the invention, with the torque sensor being associated with a bearing plate of the winch into which the free fall brake torque and/or a reaction torque induced hereby is introduced.

FIG. 6 shows a further embodiment in accordance with which a torque can also be measured at one of the two bearing plates 6 and 7, with the torque sensor 21 being associated with the bearing plate 6 in the embodiment drawn in FIG. 6. The winch drive 8 and/or the holding brake 10 are rotationally fixedly arranged at said bearing plate 6 so that torques induced at the holding brake 10 and/or at the winch drive 8 initiate a corresponding reaction torque at the bearing plate 6 that can be measured by the torque sensor 21. For this purpose, the bearing plate can be supported pivotably per se in the manner shown in FIG. 6 (*b*) and can be supported and secured against rotation by a load cell. Said load cell can in more precise terms be associated with one of the bearings to measure the load acting there that is induced by a torque that acts on the bearing plate 6.

The torque signal provided by the torque sensor 21 in the form of the load cell shown can in turn be supplied to the regulator 31 in the already described manner.

The following features can advantageously be improved or fully eliminated by the measurement of the torque in the holding brake.

- The influence of changes to the coefficients of friction (brake pad temperature) in the free fall brake can be compensated by the regulation of the control pressure.
- Independence from the oil viscosity (and oil temperature) because it can likewise be compensated.
- The detection of the characteristic values for the regulation becomes more precise and independent of influence values of the system due to the innovative measured value detection within the system of the hoisting winch.
- Setup of an overload protection for the instrument is possible because the free fall brake works in a regulated manner.
- Too high a free fall braking torque is recognized and the free fall brake is regulated.
- A support mode for removing the rope by manual force, e.g. in handling work (motor also drives during removal) can be set up.
- Provision of an open interface for future driver assistance systems with respect to a controlled free fall can be reproduced.
- The setup of a feedback-free coupling of the foot pedal (desired value specification) to the free fall brake can be provided. No actuated fallback level predefined by muscle power is required. The pedal distance and the pedal force can be used as a desired value specification from which the brake retardation or falling speed results.
- An integration in the existing installation space is possible. The proven free fall brake principle is extremely improved.
- A redevelopment of the cost-intensive parts is not necessary.
- The drive, holding brake, and free fall brake can be designed both as hydraulically actuated and as electrically actuated.

We claim:

1. A free fall winch comprising:

a drum rotationally drivable by a winch drive;

a free fall brake for braking the drum in free fall operation;

a detection device for detecting a torque that acts at the free fall winch and that depends on a free fall brake torque of the free fall brake; and a control device for controlling a braking control force of the free fall brake in dependence on the detected torque.

2. The winch of claim 1, wherein the control device has a controller module for regulating the braking control force of the free fall brake in dependence on the detected torque.

3. The winch of claim 2, wherein a desired braking torque can be supplied to the controller that is predefinable by a desired braking sensor that detects a control distance and/or a control force of a free fall brake pedal or of a free fall brake lever; and wherein the controller module is configured to regulate the braking control force such that a difference between the detected torque and the predefinable desired braking torque is as small as possible.

4. The winch of claim 3, wherein a desired rotational speed of the drum and/or a desired withdrawal speed of the rope running off the drum can be specified to the controller as a desired value and/or as a reference value;

further comprising a rotational speed detection device and/or a speed detection device for detecting the actual rotational speed of the drum and/or the actual removal speed of the rope; and wherein the controller module is configured to control the free fall brake such that the actual rotational speed and/or the actual removal speed is as close as possible to the desired rotational speed and/or a desired removal speed.

5. The winch of claim 1, wherein the detection device comprises a torque sensor integrated in the winch drive; and wherein the torque sensor is arranged directly at a motor shaft of the winch drive.

6. The winch of claim 1, wherein the detection device has a torque sensor that is associated with an input shaft of a transmission via which transmission the drum is rotationally drivable by the winch drive.

7. The winch of claim 1, wherein the detection device has a torque sensor that is associated with a holding brake and that detects a torque induced at the holding brake in free fall operation.

8. The winch of claim 7, wherein the winch drive is rotationally fastened to the holding brake such that the torque sensor associated with the holding brake detects the torque provided or intercepted by the winch drive with an open holding brake.

9. The winch of claim 7, wherein the holding brake is supported against rotation by a support; and wherein the torque sensor is associated with the support.

10. The winch of claim 1, wherein the free fall brake is supported against rotation by a support; and wherein the detection device has a torque sensor associated with the support of the free fall brake.

11. The winch of claim 1, wherein the detection device has a torque sensor that is associated with a bearing plate and measures a torque induced in the bearing plate in free fall operation.

12. The winch of claim 1, wherein the free fall brake is arranged between the winch drive and a holding brake, on the one hand, and the drum, on the other hand, such that the drum is decoupled from the winch drive and from the holding brake with an open free fall brake.

13. The winch of claim 1, wherein the free fall brake is arranged such that at least one part of the free fall brake is configured to rotate along with the drum and/or with the winch drive and such that a counter-bearing plate at which the drum is rotatably supported on a side disposed opposite the winch drive and a holding brake also remains free of torque with a closed free fall brake.

14. The winch of claim 1, wherein the free fall brake is received in the interior of a drum jacket of the drum.

15. The winch of claim 1, wherein a transmission comprises a single-stage or multi-stage planetary transmission that is received in the interior of the drum; and wherein the free fall brake is rotatably fastened at a free fall brake part to a planetary transmission element.

16. The winch of claim 1, wherein the free fall brake is actuatable by an actuation device that is arranged on a side of the drum disposed opposite the winch drive and a holding brake; and wherein the actuation device is rotatably supported at a counter-bearing plate and/or is formed as rotatable per se such that at least one part of the actuation device is freely rotatable with respect to the counter-bearing plate even with an applied free fall brake.

17. The winch of claim 1, wherein an actuation device has a rotationally stationary and axially adjustable actuation cylinder for actuating the free fall brake that is rotatably supported at least with respect to one part of the free fall brake and/or with respect to the drum.

18. The winch of claim 1, wherein the free fall brake is configured as a multi-disk brake; and wherein a first set of disks is rotationally fastened to the drum and a second set of disks is rotationally fastened to a transmission element of the transmission.

19. The winch of claim 1, wherein at least one part of the free fall brake continuously rotating along with the drum has conveying contours and/or oil circulation contours in the form of flushing grooves.

20. A method of operating a free fall winch that has a drum, a winch drive for the rotational driving of the drum, and a free fall brake for braking the drum in free fall operation, the method comprising:

detecting a torque at the free fall winch that is induced by a braking torque of the free fall brake in free fall operation of the free fall winch by a torque sensor; and automatic controlling and/or adapting of a braking control force actuating the free fall brake in dependence on the detected torque.

21. The method of claim 20, wherein a desired braking torque is predefined by detecting a control distance and/or a control force of a brake pedal or brake lever; and/or wherein a desired rotational speed of the drum is predefined in free fall operation; and wherein the control force actuating the free fall brake is regulated by a controller module in dependence on the detected torque such that a difference between the detected torque and the predefined desired braking torque and/or the difference between a detected actual rotational speed of the drum and the predefined desired rotational speed of the drum is/are as small as possible.

* * * * *